US008419482B1

(12) United States Patent
Yu et al.

(10) Patent No.: US 8,419,482 B1
(45) Date of Patent: Apr. 16, 2013

(54) ELECTRICAL CONNECTOR

(75) Inventors: Wang-I Yu, Jhonghe (TW); Hung-Chi Tai, Jhonghe (TW); Kuo-Cheng Liu, Jhonghe (TW)

(73) Assignee: Alltop Electronics (Suzhou) Ltd, Taicang (CN)

( * ) Notice: Subject to any disclaimer, the term of this patent is extended or adjusted under 35 U.S.C. 154(b) by 0 days.

(21) Appl. No.: 13/325,992

(22) Filed: Dec. 14, 2011

(30) Foreign Application Priority Data

Oct. 13, 2011 (CN) ..... 2011 1 0309844

(51) Int. Cl.
*H01R 13/10* (2006.01)

(52) U.S. Cl.
USPC ..... 439/682; 439/485

(58) Field of Classification Search ..... 439/485, 439/861, 862, 856, 682
See application file for complete search history.

(56) References Cited

U.S. PATENT DOCUMENTS

| | | | | |
|---|---|---|---|---|
| 6,705,902 | B1 * | 3/2004 | Yi et al. | 439/678 |
| 7,553,167 | B2 * | 6/2009 | Zhang et al. | 439/74 |
| 2010/0184339 | A1 * | 7/2010 | Ngo et al. | 439/682 |

* cited by examiner

*Primary Examiner* — Tho D Ta
*Assistant Examiner* — Travis Chambers
(74) *Attorney, Agent, or Firm* — Sughrue Mion, PLLC

(57) ABSTRACT

A power connector mounting on a printed circuit board (PCB), includes an insulating housing, and a number of power contacts received in the housing. The insulating housing extends along a transversal direction and defines a number of passageways extending therethrough along a front-to-back direction. The insulating housing has a top wall, an opposite bottom wall, and a pair of side walls. A beam is provided inside of the passageway. Each power contact has a main portion, a pair of contacting fingers extending from a forward edge of the main portion and distal tails extending downwards from the main portion. The pair of contacting fingers defining a groove therebetween for engaging with the beam so as to facilitate the contact being secured in the passageway with respect to said insulating housing.

11 Claims, 8 Drawing Sheets

ELECTRICAL CONNECTOR

BACKGROUND OF THE INVENTION

1. Field of the Invention

The present invention relates to an electrical connector, and more particularly to a power connector mounting on a printed circuit board (PCB).

2. Description of Related Art

Nowdays, there are many ways to assembly a plurality of contacts into an insulating housing. In some typical connectors, the contacts are physically attached to the insulating housing. Or, the contacts are inserted molded within the insulating housing. When the contacts are assembled to the insulating housing by mechanical manner, interference-fit way is usually employed. However, the contacts, which are interference-fitted in the insulating housing, are easily displaced from those original positions and correpodinging electronic performance will be damaged.

Hence, a power connector with improved structure to secure the contacts in original positions is needed.

BRIEF SUMMARY OF THE INVENTION

The present invention provides a power connector mounting on a printed circuit board (PCB), comprises an insulating housing, and a plurality of power contacts received in the housing. The insulating housing extends along a transversal direction and defines a plurality of passageways extending therethrough along a front-to-back direction. The insulating housing has a top wall, an opposite bottom wall, and a pair of side walls. A beam is provided inside of the passageway. Each power contact has a main portion, a pair of contacting fingers extending from a forward edge of the main portion and distal tails extending downwards from the main portion. The pair of contacting fingers defining a groove therebetween for engaging with the beam so as to facilitate the contact being secured in the passageway with respect to said insulating housing.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
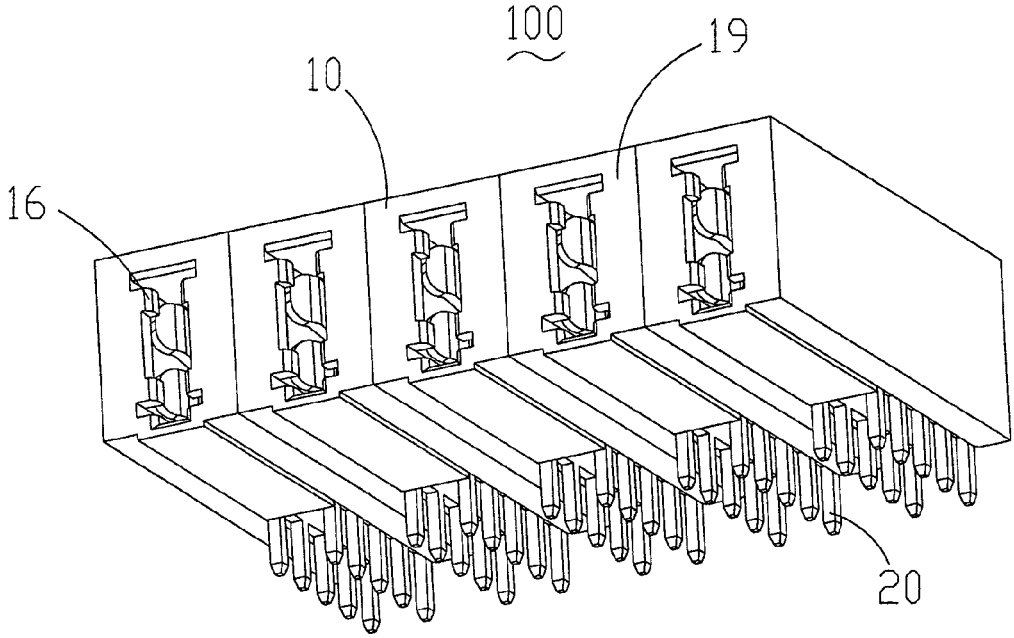
FIG. 1 is a perspective view of a power connector in accordance with the present invention.
Figure 2:
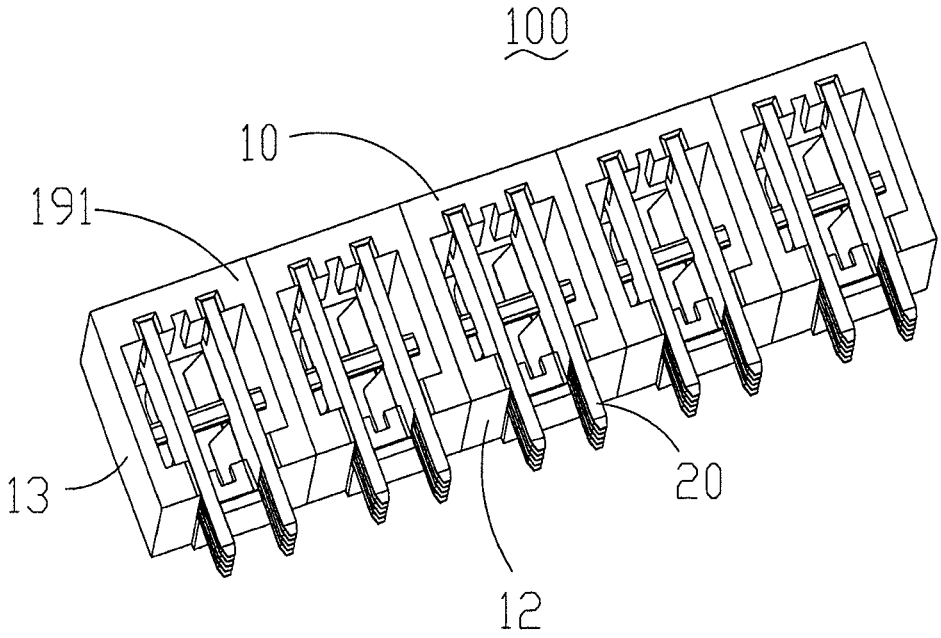
FIG. 2 is another perspective view of the power connector assembly shown in FIG. 1.

Reference will now be made to the drawing figures to describe the embodiments of the present invention in detail. In the following description, the same drawing reference numerals are used for the same elements in different drawings.

Referring to FIGS. 1-4, a power connector 100, which is mounting onto a printed circuit board (PCB, not shown), in accordance with the present invention comprises an insulating housing 10 extending along a transversal direction, and a plurality of pairs of power contacts 20 assembled to the insulating housing 10.

Figure 3:
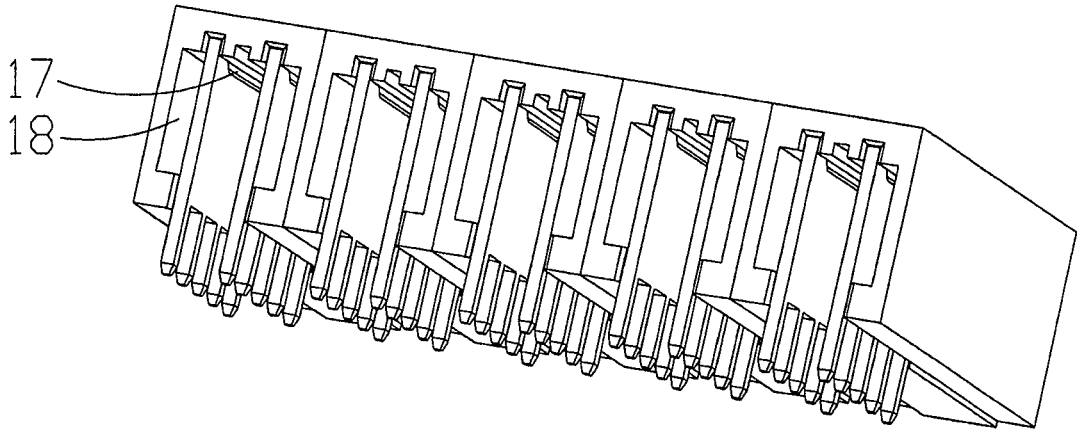
FIG. 3 is still a perspective view of the power connector.
Figure 4:
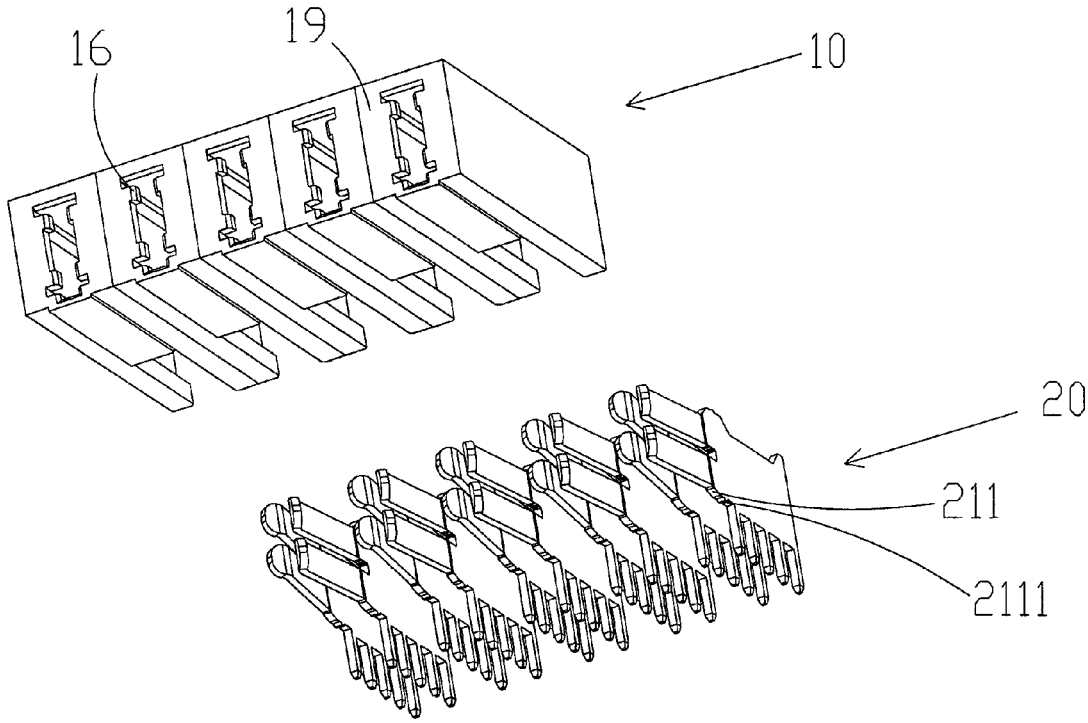
FIG. 4 is an exploded, perspective view of the power connector.
Figure 5:
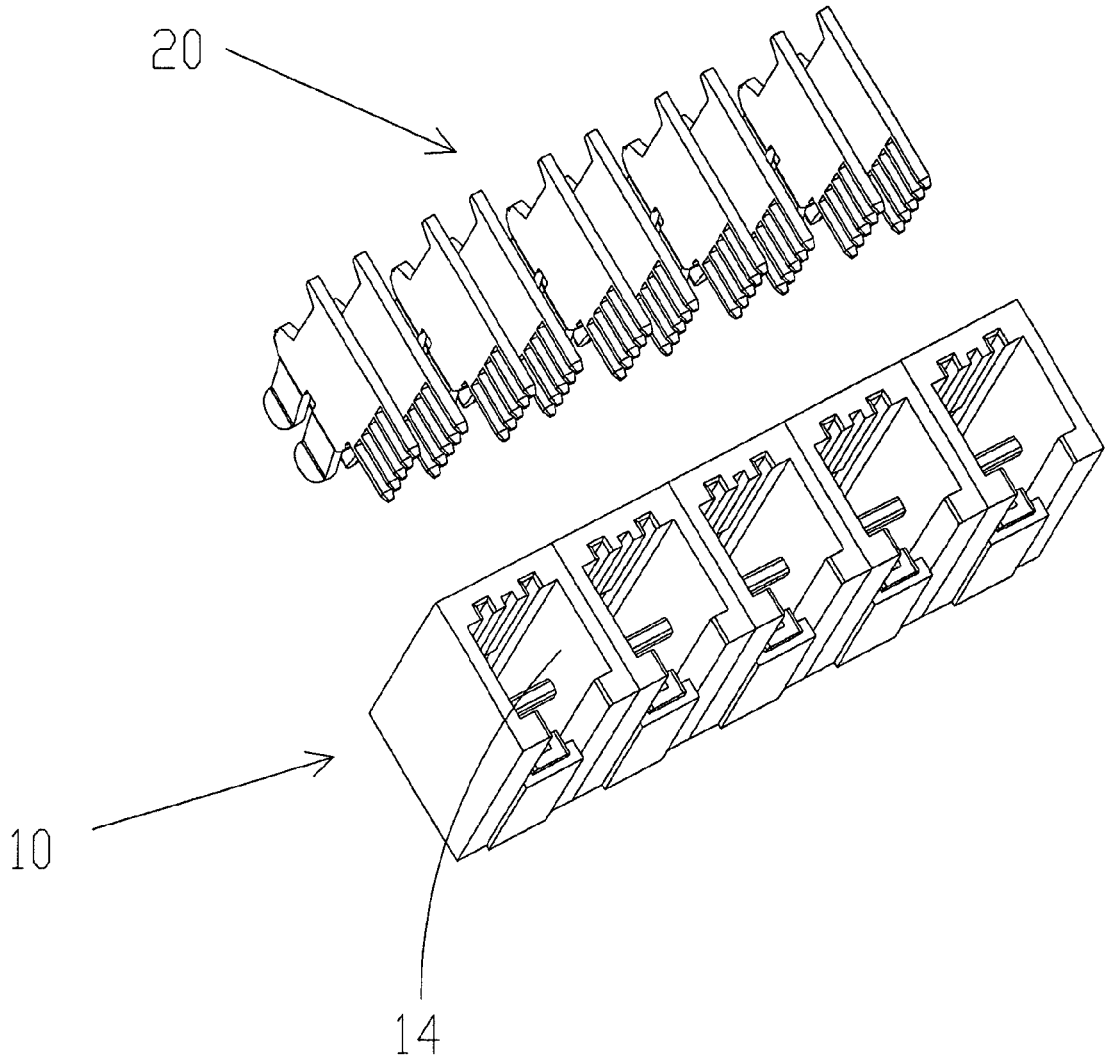
FIG. 5 is a view similar to FIG. 4 while taken from a different aspect.
Figure 6:
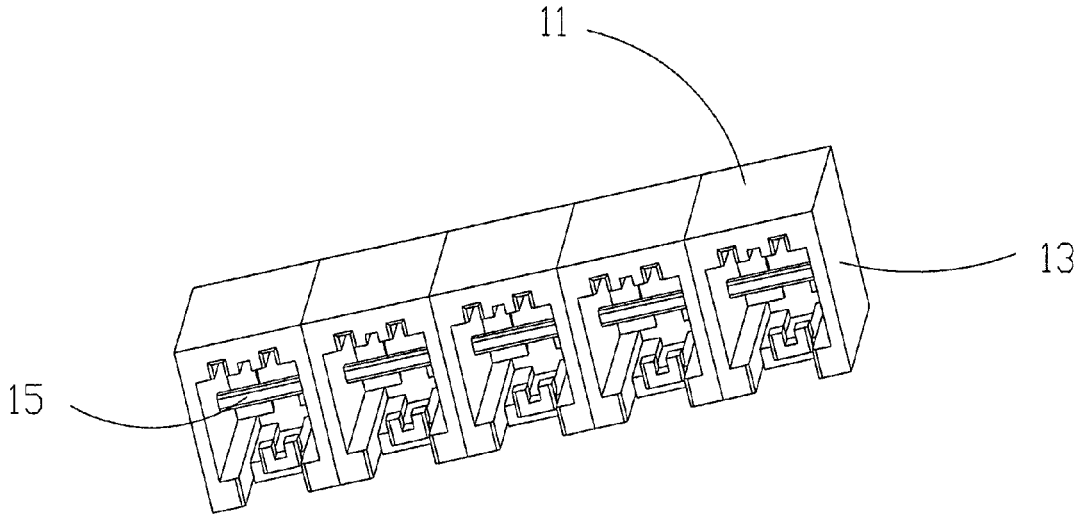
FIG. 6 is a perspective view of an insulating housing of the power connector.

Referring to FIGS. 1-4 together with FIGS. 5-6, The insulating housing 10 includes a top wall 11 (FIG. 6), an opposite bottom wall 12, and a pair of side walls 13 interconnecting the top wall 11 and the bottom wall 12. A plurality of passageways 14 are defined between the pair of side walls 13, which extend along a front-to-back direction. Each passageway 14 receives a pair of power contacts. A beam 15 is formed in each passageway 14. In the preferred embodiment, the beam 15 is provided between two opposite inside faces (not labeled) of the passageway 14, which extends across the passageway 14 and is parallel to the top wall 11 and the bottom wall 12. The beam 15 has a rectangular cross section. As can be understood, the shape of the cross section of the beam 15 is various according to different applications.

Figure 8:
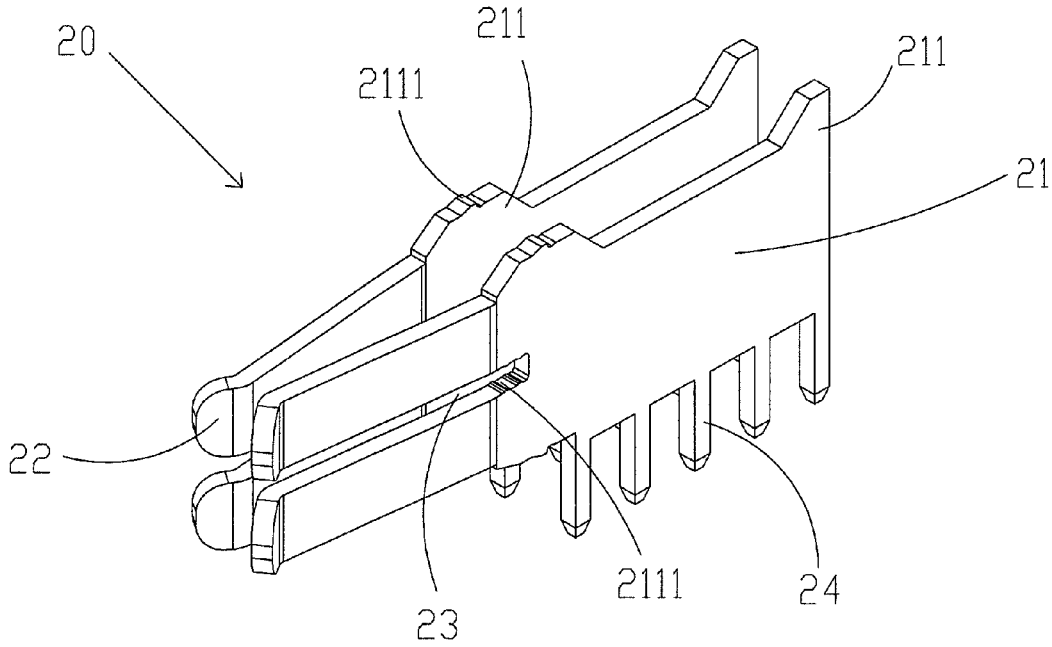
FIG. 8 is a perspective view of a pair of power contacts of the power connector.

Turning to FIG. 8 together with FIG. 4, each power contact 20 includes a flat main portion 21, a pair of contacting fingers 22 extending from a forward edge of the flat main portion 21, and a plurality of distal tails 24 extending from a bottom edge of the flat main portion 21. The pair of contacting fingers is provided with a groove 23 defined therebetween. The groove 221 is engaged with the beam 15 for preventing both a front-to-back movement and an up-to-down movement of the power contact 20. The power contact 20 has a pair of projections 211 formed along a top edge of the main portion 21. One projection 211 is located adjacent to the pair of contacting fingers 22 and the other projection 211 is located adjacent to a rear edge of the main portion 21. In the preferred embodiment, a projection 211 is also formed on a bottom edge of the main portion 21 which is opposite to one projection disposed on the top edge thereof. Each projection 211 has a barb 2111 thereon for interference-fitting within the passageway 14. As can be understood, in other embodiments, the number and the position of the projection 211 can be changed according to the application environment. In the preferred embodiment, one projection 211 is also formed within the groove 23 of the contacting fingers 22 to thereby secure the contacting fingers 22 on the beam 15.

Figure 7:
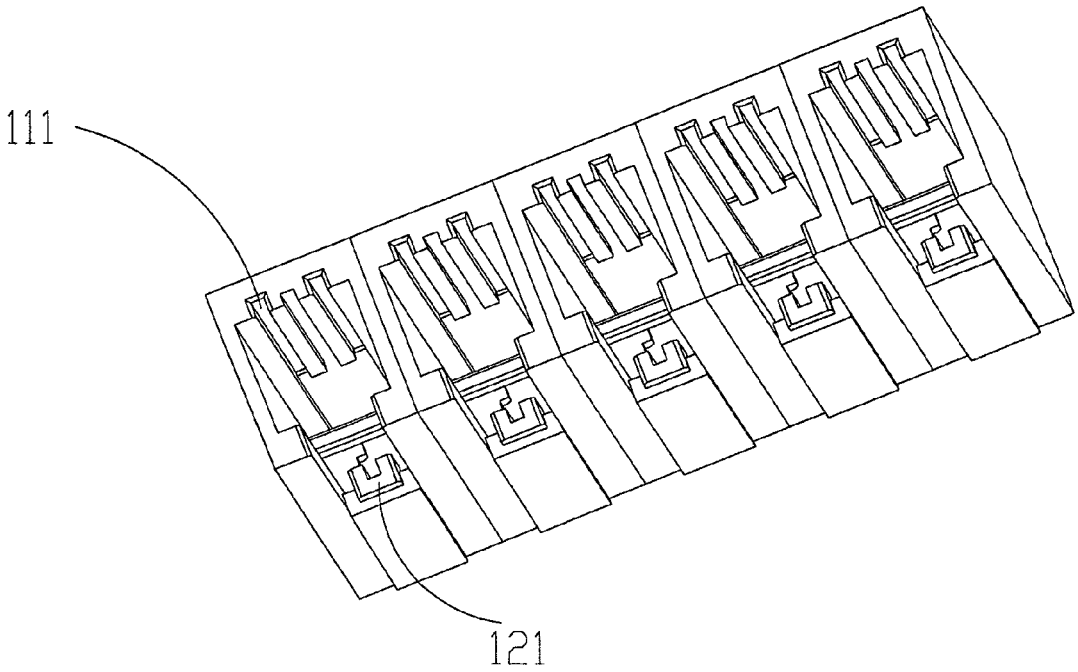
FIG. 7 is a view similar to FIG. 6 while taken from a different aspect.

Referring to FIG. 7, each passageway 14 defines a pair of slots 111 on a top face thereof for receiving respective pair of power contacts 20. A U-shaped protrusion 121 is provided on the bottom wall 12, which is cooperates with the inside faces of the passageway 14 to thereby secure the main portion 21 of the power contact 20.

Together referring to FIGS. 1 and 8, a pair of stoppers 16 is formed in each passageway 14 which is provided for engaging with forward ends of the pair of contacting fingers 22 so as to limit a forward movement of the power contact 20.

Together referring to FIGS. 3 and 8, a heat dissipation path is formed through the insulating housing 10, which includes a first heat dissipation recess 17 and a second dissipation recess 18. The first heat dissipation recess 17 is formed between the top edge of the main portion 21 of the power contact 20 and a top inside face of the passageway 14. The second heat dissipation recess 18 is formed between the main portion 21 and the inside face of the passageway 14.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A power connector mounting on a printed circuit board (PCB), comprising:

an insulating housing extending along a transversal direction and defining a plurality of passageways extending therethrough along a front-to-back direction, said insulating housing having a top wall, an opposite bottom wall, and a pair of side walls connecting said top wall and said bottom wall, said insulating housing providing a beam in each of said plurality of passageways; and a plurality of pairs of flat power contacts received in corresponding passageways, each power contact having a main portion, a pair of contacting fingers extending from a forward edge of said main portion and a plurality of distal tails extending downwards from a bottom edge of said main portion, said pair of contacting fingers defining a groove therebetween, said groove engaging with said beam in corresponding passageway of said insulating housing so as to facilitate said contact being secured in said passageway with respect to said insulating housing;

wherein said bottom wall of said insulating housing forms a U-shaped protrusion;

wherein said main portions of said pair of power contacts are received in said U-shaped protrusion and opposite inside faces.

2. The power connector as claimed in claim 1, wherein said beam extends across between inside faces of said passageway, and is parallel to said top wall and said bottom wall.

3. The power connector as claimed in claim 1, wherein said insulating housing forms at least one stopper in a front of said passageway, and wherein said stopper limits a forward movement of said power contact.

4. The power connector as claimed in claim 1, wherein said beam of said insulating housing has a rectangular cross section.

5. The power connector as claimed in claim 1, wherein each power contact forms at least one projection from edge of said main portion.

6. The power connector as claimed in claim 5, wherein said at least one projection is provided with at least one barbs for interference-fitting in said passageway.

7. The power connector as claimed in claim 6, wherein said passageway defines at least one slot therein for receiving said projection of said power contact.

8. The power connector as claimed in claim 1, wherein said insulating housing defines heat dissipation path between said main portion of said power contact and said inside faces of said passageway.

9. The power connector as claimed in claim 8, wherein said heat dissipation path includes a first heat dissipation recess and a second heat dissipation recess.

10. The power connector as claimed in claim 9, wherein said first heat dissipation recess is formed between top edge of said main portion of said power contact and said top inside face of said passageway.

11. The power connector as claimed in claim 10, wherein said second heat dissipation recess is formed between said main portion and said inside face of said passageway.

* * * * *